US007963347B2

(12) United States Patent
Pabon

(10) Patent No.: US 7,963,347 B2
(45) Date of Patent: Jun. 21, 2011

(54) SYSTEMS AND METHODS FOR REDUCING BACKWARD WHIRLING WHILE DRILLING

(75) Inventor: Jahir Alfonso Pabon, Wellesley, MA (US)

(73) Assignee: Schlumberger Technology Corporation, Cambridge, MA (US)

( * ) Notice: Subject to any disclaimer, the term of this patent is extended or adjusted under 35 U.S.C. 154(b) by 166 days.

(21) Appl. No.: 11/872,943

(22) Filed: Oct. 16, 2007

(65) Prior Publication Data

US 2009/0095531 A1 Apr. 16, 2009

(51) Int. Cl.
*E21B 7/08* (2006.01)

(52) U.S. Cl. ..... 175/75

(58) Field of Classification Search ..... 175/320, 175/92, 56, 75
See application file for complete search history.

(56) References Cited

U.S. PATENT DOCUMENTS

| | | | | |
|---|---|---|---|---|
| 1,054,812 A | | 3/1913 | Zierath | |
| 4,285,407 A | | 8/1981 | Samford | |
| 4,762,186 A | * | 8/1988 | Dech et al. | 175/61 |
| 5,560,439 A | * | 10/1996 | Delwiche et al. | 175/325.1 |
| 5,864,058 A | * | 1/1999 | Chen | 73/152.47 |
| 6,205,851 B1 | | 3/2001 | Jogi | |
| 2005/0071120 A1 | | 3/2005 | Hutchinson | |

FOREIGN PATENT DOCUMENTS

| | | |
|---|---|---|
| GB | 2403236 | * 12/2004 |
| WO | 9923346 A | 5/1999 |

OTHER PUBLICATIONS

Jardine et al., Putting a Damper on Drilling's Bad Vibrations, Oilfield Review, Jan. 1994, pp. 15-20.
Patent Cooperation Treaty, International Search Report, dated Apr. 22, 2009, 4 pages.

* cited by examiner

*Primary Examiner* — Thomas A Beach
*Assistant Examiner* — James G Sayre
(74) *Attorney, Agent, or Firm* — Brigid Laffey; Helene Raybaud

(57) ABSTRACT

According to the invention, a system for drilling a cavity in a medium is disclosed. The system may include a bottom hole assembly. The bottom hole assembly may include a first longitudinal segment and at least one drill bit. The first longitudinal segment may include a first length of chassis having a first cross section. The first cross section may be configured such that the first longitudinal segment may have a greater stiffness in a first lateral direction than in a lateral direction different than the first lateral direction.

14 Claims, 5 Drawing Sheets

SYSTEMS AND METHODS FOR REDUCING BACKWARD WHIRLING WHILE DRILLING

BACKGROUND OF THE INVENTION

This invention relates generally to drilling. More specifically the invention relates to drilling holes in earthen formations.

Existing methods known in the art for drilling in earthen formations or other non-homogenous and relatively hard mediums may encounter several difficulties, especially at deeper depths using extended drill strings and bottom hole assemblies. One potential concern, backward whirling, may be encountered when an imbalanced rotation or lateral movement of the bottom hole assembly causes impact, even briefly, with the borehole wall, or possibly a stabilizer location.

Backward whirling may occur when the borehole wall, or other object, impacts or is impacted by a spinning drill string. When the spinning bottom hole assembly contacts the borehole wall, the point of contact on the bottom hole assembly may be urged to rotate in a direction opposite the rotational direction of the bottom hole assembly. As drilling speed ("$RPM_{drill}$") increases, backward whirling speed ("$RPM_{whirl}$") can increase dramatically, especially as the difference between the borehole diameter ("$D_{borehole}$") and the bottom hole assembly ("$D_{BHA}$") decreases per the equation:

$$RPM_{whirl} = -\frac{D_{BHA}}{D_{borehole} - D_{BHA}} RPM_{drill}$$

This may not only result in lost energy and slower overall rotation of the bottom hole assembly, but damage thereto, possibly necessitating time consuming fishing-out operations.

Additionally, lateral bending of the drillstring and/or bottom hole assembly may occur due to reaction of the drill string and/or bottom hole assembly to the impact. As backward whirling increases, more frequent, larger amplitude shocks may occur to the drilling system. This may cause loss of drilling speed, related system damage (for example, a rotary table or rotational drive damage), as well as drill bit damage from unexpected lateral motion transmitted down the drill string.

BRIEF DESCRIPTION OF THE INVENTION

In one embodiment, a system for drilling a cavity in a medium is provided. The system may include a bottom hole assembly. The bottom hole assembly may include a first longitudinal segment and at least one drill bit. The first longitudinal segment may include a first length of chassis having a first cross section. The first cross section may be configured such that the first longitudinal segment may have a greater stiffness in a first lateral direction than in a lateral direction different than the first lateral direction. The at least one drill bit may be coupled with the first longitudinal segment.

In another embodiment, a method for drilling a cavity in a medium is provided. The method may include providing a bottom hole assembly. The method may also include providing a rotational motion source. The method may further include coupling, operably, the rotational motion source with the bottom hole assembly. The method may additionally include rotating the bottom hole assembly with the rotational motion source. The bottom hole assembly may include a first longitudinal segment and at least one drill bit. The first longitudinal segment may include a first length of chassis having a first cross section. The first cross section may be configured such that the first longitudinal segment may have a greater stiffness in a first lateral direction than in a lateral direction different than the first lateral direction. The at least one drill bit may be coupled with the first longitudinal segment.

In another embodiment, a system for drilling a cavity in a medium is provided. The system may include a bottom hole assembly. The bottom hole assembly may include a first longitudinal segment and a first means for abrasively contacting the medium. The first longitudinal segment may include a first length of chassis having a first cross section. The first cross section may be configured such that the first longitudinal segment may have a greater stiffness in a first lateral direction than in a lateral direction different than the first lateral direction. The system may also include a second means for rotating the first means.

BRIEF DESCRIPTION OF THE DRAWINGS

The present invention is described in conjunction with the appended figures.

Figure 1A:
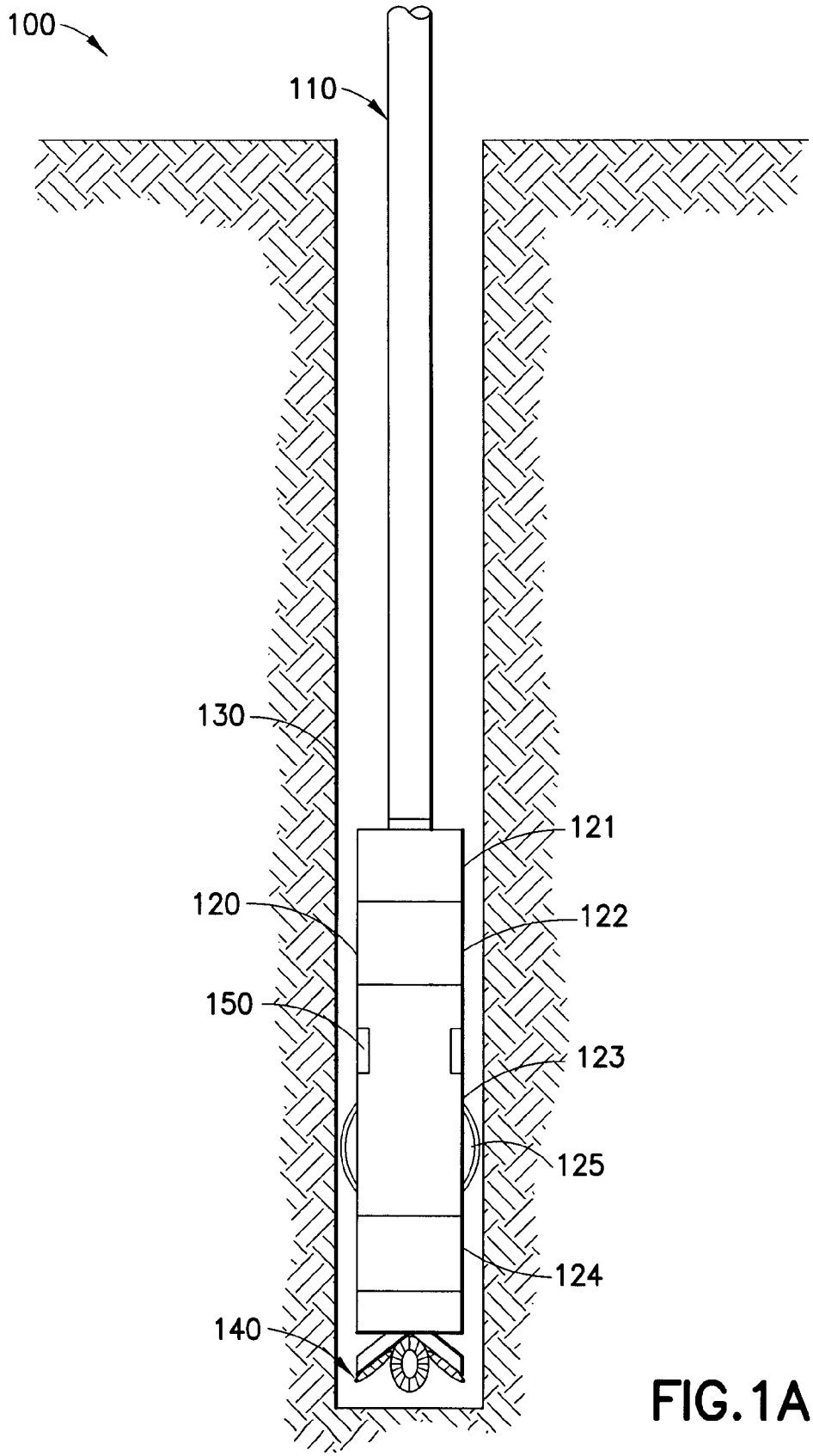
FIG. 1A is a sectional side view of a drill string with a bottom hole assembly down hole.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations may be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments.

In one embodiment of the invention, a system for drilling a cavity in a medium is provided. In some embodiments, the system may include a bottom hole assembly. Merely by way of example, the bottom hole assembly may be used to drill through formations, core formations, test formations, and/or any combination thereof. In some embodiments, the bore hole assembly may have a knuckle and/or other mechanism to allow for directional drilling.

In some embodiments, the bottom hole assembly may include a first longitudinal segment and at least one drill bit. For the purposes of this disclosure, "longitudinal" shall refer to the lengthwise nature of drill stem segments. For the purposes of this disclosure, "lateral" shall refer to directions perpendicular to the lengthwise characteristic of drill stem segments. Merely by way of example, the first longitudinal segment, and any other longitudinal segment discussed herein, may include any one or more of the following, a connector segment, a check valve assembly segment, a pressure disconnect segment, a drill collar segment, an orienting tool segment, a reamer segment, a packer segment; and/or a mud motor segment.

In some embodiments, the system may also include a second longitudinal segment. In these or other embodiments, any number of additional longitudinal segments may also be present. The second longitudinal segment may be coupled directly to, or indirectly to, another longitudinal element. In some embodiments, any given longitudinal segment may also coupled directly to, or indirectly to, another drill stem component. Merely by way of example, other drill stem components may include drill pipe and/or drill tube.

In some embodiments, the first longitudinal segment may include a first length of chassis having a first cross section. In these or other embodiments, the first cross section may be configured such that the first longitudinal segment may have a greater stiffness in a first lateral direction than in a lateral direction different than the first lateral direction. Other longitudinal segments may also have the same or varying cross sectional characteristics as the first longitudinal segment. In some embodiments, the cross section of any one or more of the chassis of the various longitudinal segments may have substantially the same cross sections.

Longitudinal segments that have greater stiffness in one lateral direction than in another later direction exhibit flexural or bending anisotropy, and will tend to bend in the direction of their minimal stiffness rather than another lateral direction. Normally, backward whirling causes continuous change of the lateral direction in which a longitudinal segment is bent. An isotropic segment will offer minimal resistance to that change in bending direction. In contrast, an anisotropic segment will tend to bend, and stay bent, in its direction of minimal bending stiffness, and will thereafter offer appreciable resistance to a change in direction of bending. That resistance considerably reduces the tendency of that anisotropic segment to undergo backward whirling.

In some embodiments, the first cross section may be substantially symmetrical about at least one of a first vector in the first lateral direction, and a second vector in a lateral direction substantially perpendicular to the first lateral direction. In some embodiments, the any vector discussed herein may pass through the rotational center and/or center of mass of the particular longitudinal segment. In these and other embodiments, the first cross section may be substantially symmetrical about multiple vectors meeting at acute and obtuse angles at the rotational center and/or center of mass of the particular longitudinal segment.

In some embodiments, any cross section of any chassis of any segment discussed herein may at least partially define a hollow portion of the length of chassis. In some embodiments, any cross section of any chassis of any segment discussed herein may also at least partially define at least one additional hollow portion of the length of chassis. In some embodiments, drilling mud, or other power and/or working fluid may use a given or available hollow portion as a fluid flow conduit.

In some embodiments, a bending anisotropy of any segment may be less than 50%. For the purposes of this disclosure, bending anisotropy shall refer to, for any given cross sectional shaped chassis, the maximum ratio between the maximum bending stiffness in any lateral direction and the minimal bending stiffness in any other lateral direction. In many embodiments, the two lateral directions from which bending anisotropy shall be the greatest ration are perpendicular directions lying in the plane of the chassis cross section.

In other embodiments, the bending anisotropy of any segment, and/or a great portion or entirety of the drill string may be about 50% (i.e. the bending stiffness in one lateral direction is about one-half more of what it is in another lateral direction). In yet another embodiments, the bending anisotropy may be between about 37.5% and about 50%, or between about 50% and 62.5%. In still yet another embodiment, the bending anisotropy may be between about 37.5% and 62.5%. In another embodiment, the bending anisotropy may be between about 50% and 75%.

In some embodiments, at least one drill bit may be coupled with the first longitudinal segment. Merely by way of example, the drill bit may be a rotary drilling bit such as a fishtail bit, a diamond drilling bit, a hard formation bit, a soft formation bit, a tungsten carbide bit, or a milling bit. In some embodiments, a coring bit may also, or alternatively, be employed.

In some embodiments, the system may also include a rotational motion source and a drill pipe. The rotational motion source may include any rotational source known in the art or equivalent systems, apparatuses, and devices. The drill pipe, or in other embodiments, drill tubing, may be operably coupled with the rotational motion source, and may also be coupled with the bottom hole assembly. In some embodiments, the drill pipe may be fixedly coupled with the bottom hole assembly, while in other embodiments, for example, directional drilling systems, the drill pipe may be at least partially rotatably coupled with the bottom hole assembly.

In some embodiments, at least a portion of the drill pipe may have a cross section configured such that the portion of the drill pipe has a greater stiffness in a second lateral direction than in a lateral direction different than the second lateral direction. As above with respect to the longitudinal segments, the bending anisotropy of any section, or all, of the drill pipe may lie within the ranges discussed.

In another embodiment of the invention, a method for drilling a cavity in a medium is provided. In some embodiments, the method may include providing a bottom hole assembly. In these embodiments, the bottom hole assembly may include bottom hole assemblies substantially as described above.

In some embodiments, the method may also include providing a rotational motion source. In these embodiments, the rotational motion source may include rotational motion sources substantially as described above. The method may further include coupling, operably, the rotational motion source with the bottom hole assembly.

In some embodiments, coupling, operably, the rotational motion source with the bottom hole assembly may include coupling the rotational motion source with the bottom hole assembly via an indirect coupling with, merely by way of example, drill pipe. As above, the drill pipe or other intermediary may be fixedly or at least partially rotatably coupled with the bottom hole assembly possibly depending on the drilling application. In some embodiments, at least a portion of the drill pipe may have a greater stiffness in one lateral direction than in another lateral direction different than the first lateral direction.

The method may additionally include rotating the bottom hole assembly with the rotational motion source. The bottom hole assembly may include a first longitudinal segment and at least one drill bit. The first longitudinal segment may include a first length of chassis having a first cross section. The first cross section may be configured such that the first longitudinal segment may have a greater stiffness in a first lateral direction than in a lateral direction different than the first lateral direction. The at least one drill bit may be coupled with the first longitudinal segment.

In another embodiment, a system for drilling a cavity in a medium is provided. The system may include a bottom hole assembly. The bottom hole assembly may include a first longitudinal segment and a first means for abrasively contacting the medium. In one embodiment, the first means may include at least one drill bit coupled with the first longitudinal segment. In these or other embodiments, the first means may also include any system, device, apparatus, etc. discussed herein which may be employed to abrasively contact the medium In some embodiments, the first longitudinal segment may include a first length of chassis having a first cross section. The first cross section may be configured such that the first longitudinal segment may have a greater stiffness in a first lateral direction than in a lateral direction different than the first lateral direction. In some embodiments, these cross sections may be substantially as described above.

In some embodiments, the system may also include a second means for rotating the first means. In one embodiment, the second means may include a rotational motion source operably coupled with the first means. The rotational motion source may be substantially as described above. In these or other embodiments, the second means may also, merely by way of example, include a drill pipe or coiled tubing coupled with the first means. In all of these or other embodiments, the second means may also include any system, device, apparatus, etc. discussed herein which may be employed to rotate the first means.

Turning now to FIG. 1A, a sectional side view 100 of an exemplary drill string 110 with bottom hole assembly 120 down hole 130 is shown. Drill string 110 is coupled with a rotational motion source (not shown), and is drilling out hole 130 via drill bits 140. The bottom hole assembly 120 is shown with a check valve 121, a pressure disconnect 122, an orienting tool 123, a reamer 125 and a mud motor 124. Stabilizers 150 are shown creating a choke point in hole 130, which may cause backward whirling. In other examples, a natural feature of the medium surrounding the hole, or possibly a damaged exterior of the bottom hole assembly 120, may cause the choke point. Though not apparent due to the large scale of FIG. 1A, distortion of the shape of bottom hole assembly 120 may occur when, during turning, bottom hole assembly 120 impacts the choke point during rotation (caused here by stabilizers 150).

Figure 1B:
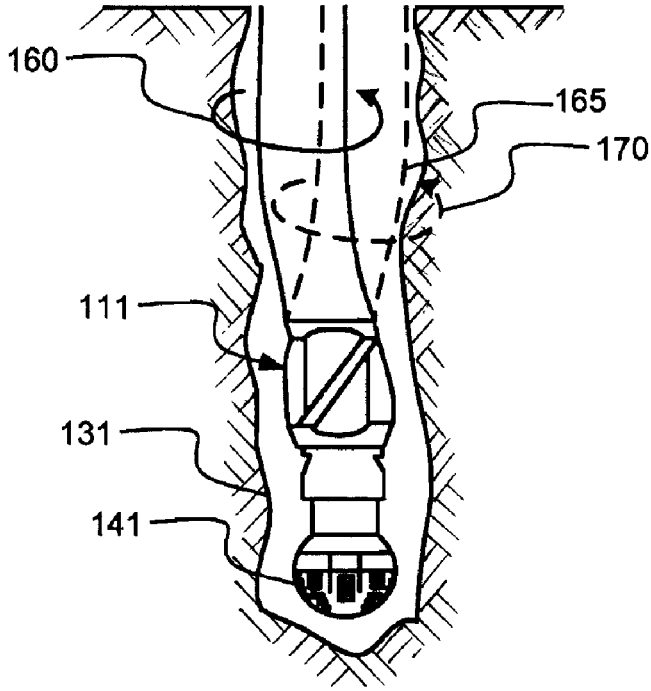
FIG. 1B is a sectional side view of a drill string with a bottom hole assembly down hole showing exaggerated backward whirling conditions.
Figure 1C:
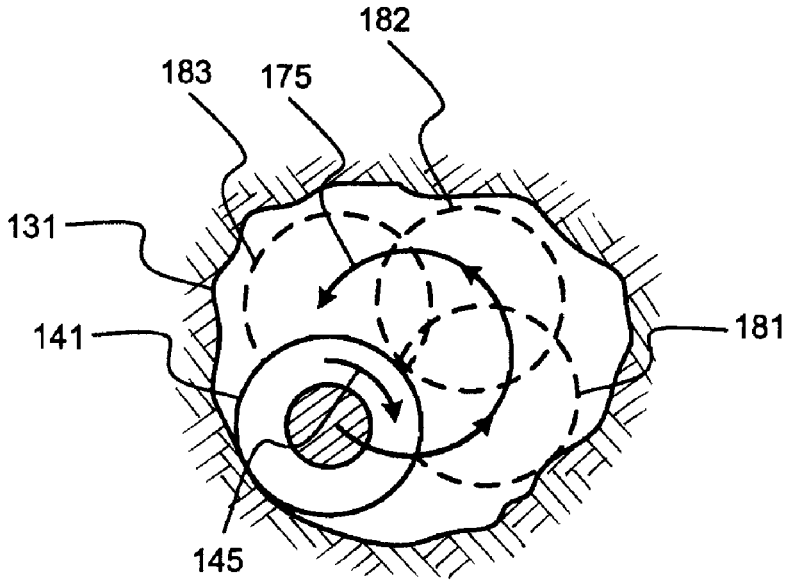
FIG. 1C is a bottom-hole view of a drill string with a bottom hole assembly down hole showing exaggerated backward whirling conditions.

FIG. 1B shows a sectional side view of a drill string, similar to the one in FIG. 1A, with a bottom hole assembly 111 down hole 131 showing exaggerated backward whirling conditions. As bottom hole assembly 111 rotates in the direction of arrow 160 and experiences backward whirling, bottom hole assembly will flex as shown via dashed lines 165, while continuing to rotate as shown by arrow 170. Viewed from underneath the drill bit 141, FIG. 1C shows an exaggerated effect on the cross sectional drilling area due to the backward whirling, and how vertical drilling speed may be lost, at least in part, to unintended widening of bore hole 131. Backward whirling conditions will cause drill bit 141, while turning in direction 145, to rotate about the cross sectional area of bore bole 131 as shown by arrow 175, and dashed representations of bit 141 in other positions 181, 182, 183.

Figure 2A:
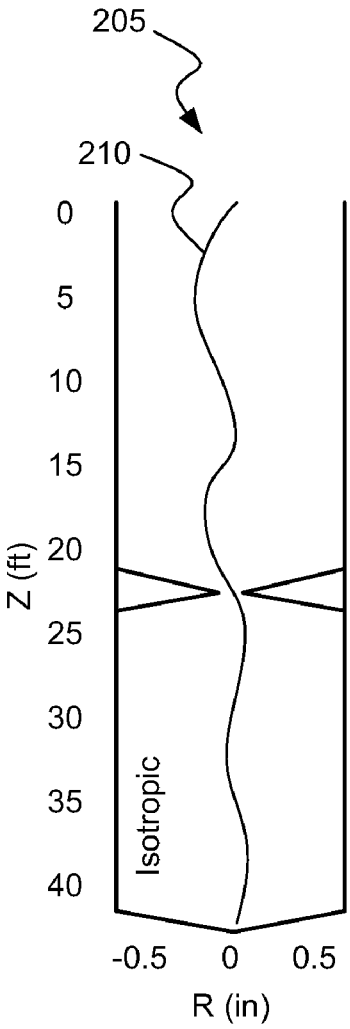
FIG. 2A is a graph representative of a bottom hole assembly with an isotropic chassis under backward whirling conditions.

FIG. 2A shows a graph 205 representative of a bottom hole assembly with an isotropic chassis under backward whirling conditions. An isotropic chassis is a chassis with a cross section that is isotropic, i.e. the chassis does not have a greater bending stiffness in any one lateral direction than any other. The curved line 210 represents the curvature of this bottom hole assembly at approximately three seconds after rotation of bottom hole assembly begins at 300 rotations per minute ("RPM"). As can be seen in FIG. 2A, backward whirling has caused the shape of the bottom hole assembly to distort, consuming energy that would otherwise be applied to down hole rotational drilling. A speed of 300 RPM is used in this and other examples herein, merely for the purposes of illustration. Backward whirling can occur at much lower rotational speeds, especially where the tolerance between the bore hole and the bottom hole assembly is small, but the concepts illustrated herein may be used under a variety of situations and operational parameters to reduce or eliminate backward whirling.

Figure 2B:
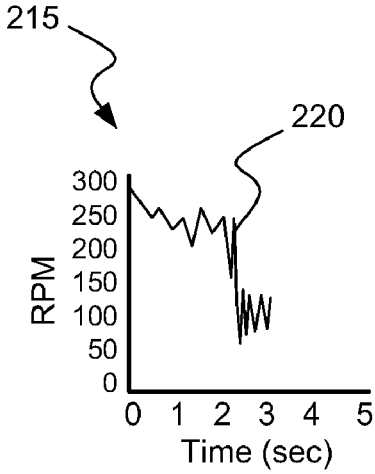
FIG. 2B is a graph representative of the rotational speed of the bottom hole assembly of FIG. 2A as affected by backward whirling.

FIG. 2B shows a graph 215 representative of the rotational speed of the bottom hole assembly of FIG. 2A as affected by backward whirling. Line 220 represents the rotational speed of the bottom hole assembly at times up to three seconds after rotation of the bottom hole assembly begins. As can be seen in FIG. 2B, impact with the choke point in the hole, as well as consequent backward whirling, has caused the rotational speed of the bottom hole assembly to vary from the expected more linear 300 RPM performance.

Figure 3A:
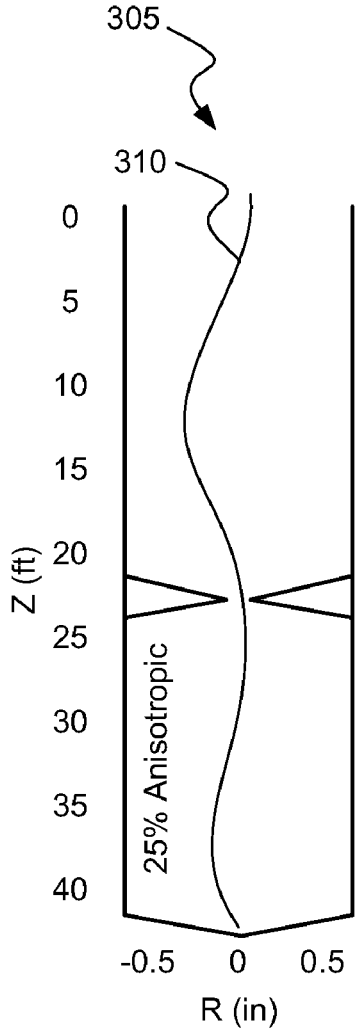
FIG. 3A is a graph representative of a bottom hole assembly with a 25% anisotropic chassis under backward whirling conditions.

FIG. 3A shows a graph 305 representative of a bottom hole assembly with a 25% anisotropic chassis under backward whirling conditions. A 25% anisotropic chassis is a chassis with a cross section that is has a 25% greater bending stiffness in one lateral direction than another lateral direction. The curved line 310 represents the curvature of this bottom hole assembly at approximately three seconds after rotation of bottom hole assembly begins at 300 RPM. As can be seen in FIG. 3A, backward whirling has caused the shape of the bottom hole assembly to distort, but the distortion of the 25% anisotropic chassis is less than that of the isotropic chassis shown in FIG. 2A.

Figure 3B:
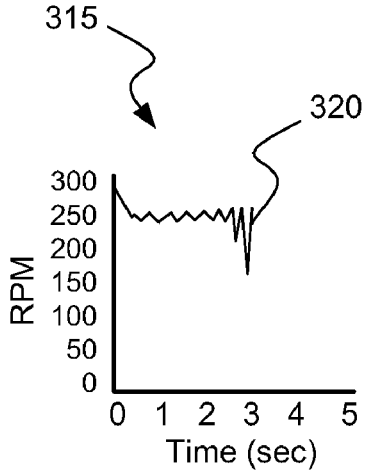
FIG. 3B is a graph representative of the rotational speed of the bottom hole assembly of FIG. 3A as affected by backward whirling.

FIG. 3B shows a graph 315 representative of the rotational speed of the bottom hole assembly of FIG. 3A as affected by backward whirling. Line 320 represents the rotational speed of the bottom hole assembly at times up to three seconds after rotation of the bottom hole assembly begins. As can be seen in FIG. 3B, variation and reduction of the rotational speed of the bottom hole assembly has been affected by backward whirling, but less than that of the isotropic chassis shown in FIG. 2B.

Figure 4A:
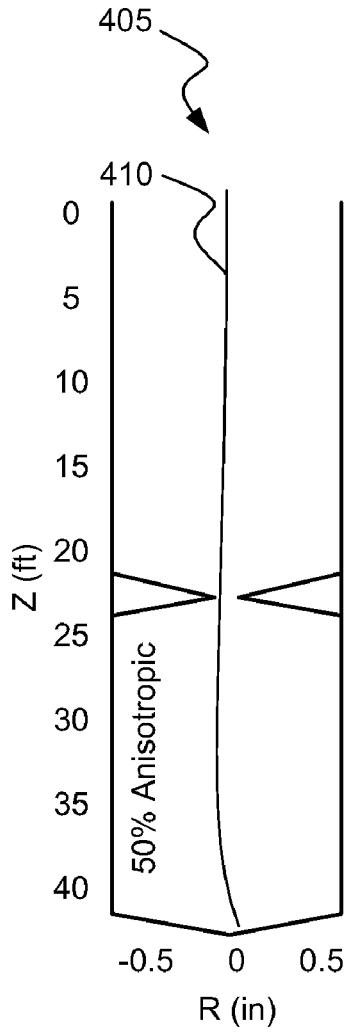
FIG. 4A is a graph representative of a bottom hole assembly with a 50% anisotropic chassis under backward whirling conditions.

FIG. 4A shows a graph 405 representative of a bottom hole assembly with a 50% anisotropic chassis under what would otherwise be backward whirling conditions as seen in FIG. 1A and FIG. 2A. A 50% anisotropic chassis is a chassis with a cross section that is has a 50% greater bending stiffness in one lateral direction than another lateral direction. The curved line 410 represents the curvature of this bottom hole assembly at approximately three seconds after rotation of bottom hole assembly begins at 300 RPM. As can be seen in FIG. 4A, the shape of the bottom hole assembly has distorted somewhat, but the distortion of the 50% anisotropic chassis is less than that of the isotropic chassis shown in FIG. 2A and the 25% anisotropic chassis shown in FIG. 3A. Furthermore, the distortion will be consistent as the bottom hole assembly rotates, as flexural anisotropy has prevented backward whirling from occurring. In this embodiment, the bottom hole assembly may maintain its distorted shape in a consistent lateral direction relative to its axis as it rotates in the hole, thereby not exhibiting backward whirling characteristics.

Figure 4B:
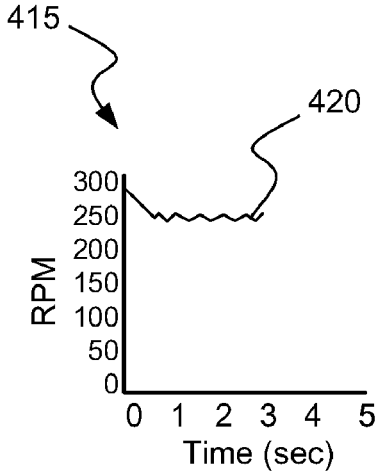
FIG. 4B is a graph representative of the rotational speed of the bottom hole assembly of FIG. 4A as affected by backward whirling.

FIG. 4B shows a graph 415 representative of the rotational speed of the bottom hole assembly of FIG. 4A showing that backward whirling is not occurring, and therefore only minimal variation in rotational speed is occurring. Line 420 represents the rotational speed of the bottom hole assembly at times up to three seconds after rotation of the bottom hole assembly begins. As can be seen in FIG. 4B, variation and reduction of the rotational speed of the bottom hole assembly is less than that of the isotropic chassis shown in FIG. 2B and the 25% anisotropic chassis shown in FIG. 3B.

Figure 5A:
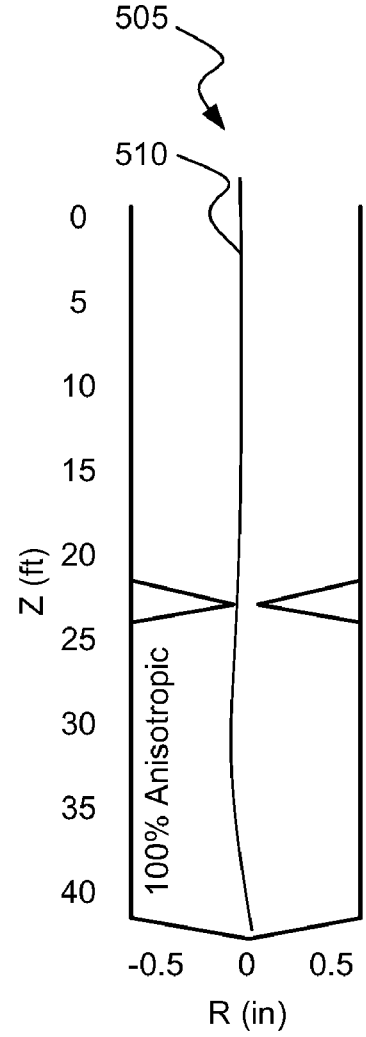
FIG. 5A is a graph representative of a bottom hole assembly with a 100% anisotropic chassis under backward whirling conditions.

FIG. 5A shows a graph 505 representative of a bottom hole assembly with a 100% anisotropic chassis under what would otherwise be backward whirling conditions as seen in FIG. 1A and FIG. 2A. A 100% anisotropic chassis is a chassis with a cross section that is has a 100% greater bending stiffness in one lateral direction than in another lateral direction. The curved line 510 represents the curvature of this bottom hole assembly at approximately three seconds after rotation of bottom hole assembly begins at 300 RPM. As can be seen in FIG. 5A, the shape of the bottom hole assembly has distorted somewhat, but the distortion of the 100% anisotropic chassis is less than that of the isotropic chassis shown in FIG. 2A and the 25% anisotropic chassis shown in FIG. 3A. This distortion is similar to the distortion of the 50% anisotropic chassis, and still less than that of the isotropic chassis shown in FIG. 2A and the 25% anisotropic chassis shown in FIG. 3A. Furthermore, the distortion will be consistent as the bottom hole assembly rotates, as flexural anisotropy has prevented backward whirling from occurring. In this embodiment, the bottom hole assembly may maintain its distorted shape in a consistent lateral direction relative to its axis as it rotates in the hole, thereby not exhibiting backward whirling characteristics.

Figure 5B:
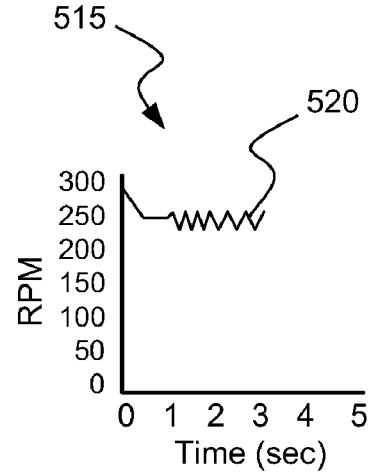
FIG. 5B is a graph representative of the rotational speed of the bottom hole assembly of FIG. 4A as affected by backward whirling.

FIG. 5B shows a graph 515 representative of the rotational speed of the bottom hole assembly of FIG. 5A showing that backward whirling is not occurring, and therefore only minimal variation in rotational speed is occurring. Line 520 represents the rotational speed of the bottom hole assembly at times up to three seconds after rotation of the bottom hole assembly begins. As can be seen in FIG. 5B, variation and reduction of the rotational speed of the bottom hole assembly is less than that of the isotropic chassis shown in FIG. 2B and the 25% anisotropic chassis shown in FIG. 3B, but is somewhat more variable than the variation shown by the 50% anisotropic chassis in FIG. 4B.

Figure 6A:
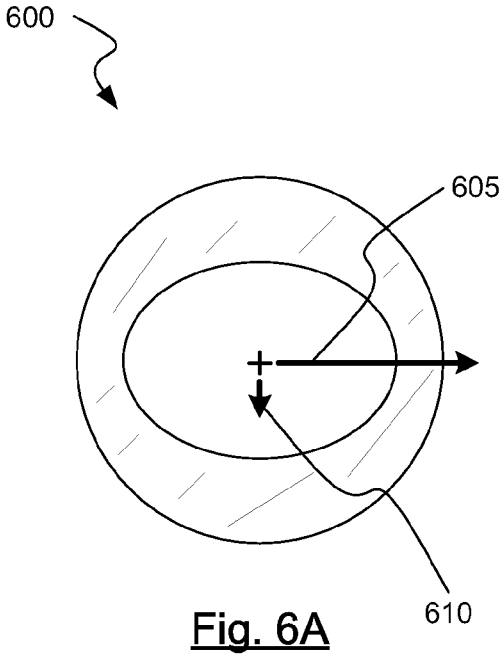
FIG. 6A is a sectional plan view of a cross section of a first bottom hole assembly section having an anisotropic chassis.

FIG. 6A is a sectional plan view of an exemplary cross section 600 of a first bottom hole assembly section having an anisotropic chassis. In this embodiment, the bottom hole assembly may have a lower bending stiffness in the direction of arrow 605 than in the direction of arrow 610 (the greater the size of the arrow, the greater the flexibility). The geometry of cross section 600 may be modified to adjust the precise percentage of anisotropy to provide for different amounts of damping of backward whirling.

Figure 6B:
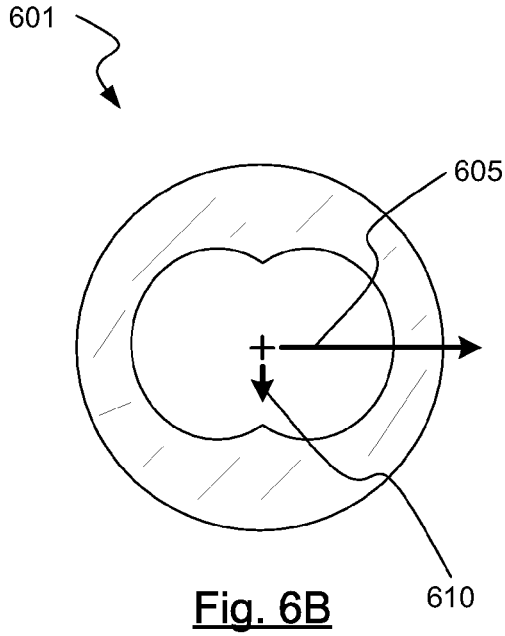
FIG. 6B is a sectional plan view of a cross section of a second bottom hole assembly section having an anisotropic chassis.

FIG. 6B is a sectional plan view of another exemplary cross section 601 of a second bottom hole assembly section having an anisotropic chassis. In this embodiment, the bottom hole assembly may have a lower bending stiffness in the direction of arrow 605 than in the direction of arrow 610. The geometry of cross section 601 may be modified to adjust the precise percentage of anisotropy to provide for different amounts of damping of backward whirling.

Figure 6C:
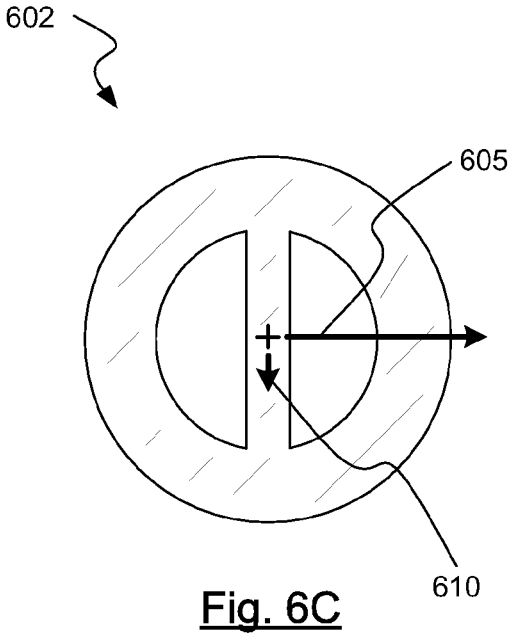
FIG. 6C is a sectional plan view of a cross section of a third bottom hole assembly section having an anisotropic chassis.

FIG. 6C is a sectional plan view of an exemplary cross section 602 of a third bottom hole assembly section having an anisotropic chassis. In this embodiment, the bottom hole assembly may have a lower bending stiffness in the direction of arrow 605 than in the direction of arrow 610. The geometry of cross section 602 may be modified to adjust the precise percentage of anisotropy to provide for different amounts of damping of backward whirling. Also shown in cross section 602 is how some embodiments may have multiple separate cavities defined. In some embodiments, drilling mud fluid, tools, and/or other equipment may occupy one cavity, while other drilling mud fluid, tools, and/or other equipment may occupy the other cavity.

Figure 6D:
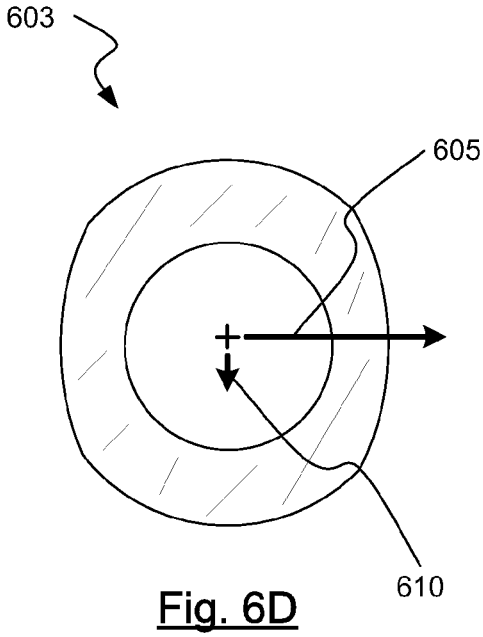
FIG. 6D is a sectional plan view of a cross section of a fourth bottom hole assembly section having an anisotropic chassis.

FIG. 6D is a sectional plan view of an exemplary cross section 603 of a fourth bottom hole assembly section having an anisotropic chassis. In this embodiment, the bottom hole assembly may have a lower bending stiffness in the direction of arrow 605 than in the direction of arrow 610. The geometry of cross section 603 may be modified to adjust the precise percentage of anisotropy to provide for different amounts of damping of backward whirling.

In some embodiments, different bore hole assemblies, or different longitudinal segments of bore hole assemblies, may behave differently under different drilling conditions (i.e. speed of drilling, hardness of medium, tolerance with bore hole). Therefore, different amounts of bending anisotropy may be possibly desired for different applications and/or different segments of a particular bore hole assembly. In any particular case, a series of computer based modelings and/or simulations may be conducted for each segment of a bore hole assembly to identify those segments most prone to exhibit backward whirling under the given drilling conditions, and what amount of bending anisotropy for each of those segments will at least assist in reducing backward whirling of those segments. By optimizing each longitudinal segment of a bore hole assembly employed in a given drilling situation, backward whirling can be reduced, minimized, and/or eliminated.

An number of other possible cross sections may be utilized to achieve the proper anisotropic characteristics to reduce backward whirling. In some embodiments, not curved interior or exterior profiles may also be employed. In some embodiments, the shape of the cross section may also be shaped to provide for mass balanced rotation about the axis of the bottom hole assembly.

The invention has now been described in detail for the purposes of clarity and understanding. However, it will be appreciated that certain changes and modifications may be practiced within the scope of the appended claims

What is claimed is:

1. A system for drilling a cavity in an earthen medium, wherein the system comprises:
- a bottom hole assembly, wherein the bottom hole assembly comprises:
  - a first longitudinal segment, wherein:
    - the first longitudinal segment comprises a first length of chassis having a first cross section; and
    - the first cross section is configured such that the first longitudinal segment has a greater stiffness in a first lateral direction than in a lateral direction different than the first lateral direction resulting in a bending anisotropy;
  - at least one drill bit, wherein the at least one drill bit is coupled with the first longitudinal segment; and
- a second longitudinal segment, wherein:
  - the second longitudinal segment comprises a second length of chassis having a second cross section; and
  - the second cross section is configured such that the second longitudinal segment has a greater stiffness in a second lateral direction than in a lateral direction different than the second lateral direction.

2. The system for drilling a cavity in a medium of claim 1 wherein the first cross section is substantially the same as the second cross section.

3. The system for drilling a cavity in a medium of claim 1 wherein at least one of the first longitudinal segment and the second longitudinal segment is selected from a group consisting of:
- a connector segment;
- a check valve assembly segment;
- a pressure disconnect segment;
- a drill collar segment;
- an orienting tool segment;
- a reamer segment; and
- a mud motor segment.

4. The system for drilling a cavity in a medium of claim 1, wherein the first cross section is substantially symmetrical about at least one of a first vector in the first lateral direction and a second vector in a lateral direction substantially perpendicular to the first lateral direction.

5. The system for drilling a cavity in a medium of claim 1, wherein the first cross section at least partially defines at least one of a first hollow portion of the first length of chassis and a second hollow portion of the first length of chassis.

6. The system for drilling a cavity in a medium of claim 1, wherein the bending anisotropy of the first longitudinal segment is less than about 50 percent.

7. The system for drilling a cavity in a medium of claim 1, wherein the bending anisotropy of the first longitudinal segment is about 50 percent.

8. The system for drilling a cavity in a medium of claim 1, wherein the drill bit comprises a coring bit.

9. The system for drilling a cavity in a medium of claim 1, wherein the system further comprises:
- a rotational motion source; and
- a drill pipe, wherein:
  - the drill pipe is operably coupled with the rotational motion source;
  - the drill pipe is coupled with the bottom hole assembly;
  - the drill pipe has a second cross section; and
- the second cross section is configured such that the portion of the drill pipe has a greater stiffness in a second lateral direction than in a lateral direction different than the second lateral direction.

10. A method for drilling a cavity in an earthen medium, wherein the method comprises:
- providing a bottom hole assembly, wherein the bottom hole assembly comprises:
  - at least a first longitudinal segment, wherein:
    - the at least first longitudinal segment comprises a first length of chassis having a first cross section; and
    - the first cross section is configured such that the at least first longitudinal segment has a greater stiffness in a first lateral direction than in a lateral direction different than the first lateral direction resulting in a bending anisotropy; and
  - at least one drill bit, wherein the at least one drill bit is coupled with the at least first longitudinal segment;
- providing a rotational motion source;
- coupling, operably, the rotational motion source with the bottom hole assembly;
- rotating the bottom hole assembly with the rotational motion source; and
- a second longitudinal segment, wherein:
- the second longitudinal segment comprises a second length of chassis having a second cross section; and
- the second cross section is configured such that the second longitudinal segment has a greater stiffness in a second lateral direction than in a lateral direction different than the second lateral direction.

11. The method for drilling a cavity in a medium of claim 10, wherein coupling, operably, the rotational motion source with the bottom hole assembly comprises:
- coupling, operably, the rotational motion source with a drill pipe;
- coupling the drill pipe with the bottom hole assembly, wherein:
  - the drill pipe is operably coupled with the rotational motion source;
  - the drill pipe is coupled with the bottom hole assembly;
  - the drill pipe has a second cross section; and the second cross section is configured such that the portion of the drill pipe has a greater stiffness in a second lateral direction than in a lateral direction different than the second lateral direction.

12. The method for drilling a cavity in a medium of claim 10, wherein the bending anisotropy of the first longitudinal segment is less than about 50 percent.

13. The method for drilling a cavity in a medium of claim 10, wherein the bending anisotropy of the first longitudinal segment is about 50 percent.

14. The method for drilling a cavity in a medium of claim 10, wherein the method further comprises:

providing the bottom hole assembly with a plurality of longitudinal segments;

running with a computer a series of simulation to identify at least one segment among the plurality of longitudinal segments that will be configured such that it has a greater stiffness in a first lateral direction than in a lateral direction different than the first lateral direction;

assigning a determined bending anisotropy to each of the at least one segment; and configuring each of the at least one segment according to the assigned bending anisotropy.

* * * * *